United States Patent [19]

Flynn

[11] Patent Number: 4,944,518

[45] Date of Patent: Jul. 31, 1990

[54] GOLF SWING PRACTICE AND EXERCISE APPARATUS

[76] Inventor: William R. Flynn, 1707 Three Lakes Dr., Troy, Mich. 48098

[21] Appl. No.: 355,193

[22] Filed: May 22, 1989

[51] Int. Cl.[5] ..... A63B 69/36

[52] U.S. Cl. ..... 273/186 A; 273/194 R; 273/191 B; 273/193 A; 272/136; 272/142; 272/143

[58] Field of Search ..... 272/900, 136, 142, 143, 272/124, 125; 273/191 B, 186 A, 194 R, 193 A

[56] References Cited

U.S. PATENT DOCUMENTS

| | | | |
|---|---|---|---|
| 2,848,234 | 8/1958 | Brandon | 273/186 R |
| 3,462,156 | 8/1969 | Gentry | 273/186 R |
| 3,618,942 | 11/1971 | Bates | 272/136 |
| 3,966,203 | 6/1976 | Bickford | 273/191 B |
| 4,253,663 | 3/1981 | Hughes | 272/136 |
| 4,353,556 | 10/1982 | Self et al. | 273/186 A |
| 4,428,578 | 1/1984 | Kirkpatrick | 272/136 |
| 4,449,708 | 5/1984 | Humphrey | 273/186 A |
| 4,468,022 | 8/1984 | Wu | 272/93 |
| 4,535,991 | 8/1985 | Boatright | 273/191 B |

*Primary Examiner*—George J. Marlo
*Attorney, Agent, or Firm*—Basile and Hanlon

[57] ABSTRACT

A golf swing exercise apparatus includes an extensible band exhibiting force to extension. First and second attachment loops are formed at opposite ends of the band to mount the band at one end to a stationary support surface and to removably receive the shaft of a golf club at another end. Movement of the golf club under force extends the band to simulate a portion of a golf club swing. A bracket including a base and a perpendicular leg are removably mountable below the bottom edge of a support. A vertical post is mounted on the base for receiving the first end of the band to securely attach the first end of the band to the bracket.

2 Claims, 1 Drawing Sheet

GOLF SWING PRACTICE AND EXERCISE APPARATUS

BACKGROUND OF THE INVENTION

Field of the Invention

This invention relates, in general, to exercise apparatus and, more specifically, to exercise apparatus for practicing a golf swing.

A proper golf swing is essential if a golfer is to hit a golf ball accurately with distance. However, the swinging of a golf club involves a complicated series of movements which require a considerable amount of practice to perfect. Strength in the arms, shoulders and legs are well as timing, balance and proper weight shift are all important factors that must be mastered for a proper golf swing.

Practice is essential to the attainment of a proper golf swing. Typically, a golf swing can be practiced by a golfer only at a golf course, a driving range or on a lawn or field. However, the need to travel to the course or driving range and the effects of adverse weather all combine to limit practice time. In addition, the demands of family and business further restrict the amount of time available for practice.

As such, numerous golf swing practice and exercise devices have been developed to enable a golfer to practice golf swings indoors or at more convenient times without the need for travel to a golf course or driving range. One type of golf swing device include cords which exert a force against movement of a handle or grip to enable a golfer to simulate a golf swing. Such cords are mounted to a support surface, such as a wall or door, located in the vicinity of the practicing golfer.

Other golf swing practice devices force the golfer to swing a golf club through a fixed path similar to a proper golf swing. Other golf swing practice devices merely strengthen muscles used in a golf swing; rather than concentrating on the form of the swing or the coordination of movements in a golf swing.

While certain of these devices are effective in enabling a golfer to practice and/or perfect a proper golf swing, they are not without their limitations. The known golf practice devices are bulky or require a fixed attachment to a support surface which limits their easy portability between use sites. Other such devices do not employ an actual golf club when using the device and thereby do not come close to simulating an actual golf club swing.

Thus, it would be desireable to provide a golf swing exercise apparatus which overcomes the problems of previously developed golf swing practice or training devices. It would also be desirable to provide a golf swing exercise device which is portable and can be quickly and easily set up and used. It would also be desirable to provide a golf swing exercise apparatus which uses an actual golf club, including any wood, iron or putter. It would also be desirable to provide a golf swing exercise apparatus which is usable by both right and left handed golfers. It would also be desirable to provide a golf swing apparatus which increases the strength of the user as well as teaching proper coordination of movement and balance during a golf swing. Finally, it would be desirable to provide a golf swing exercise apparatus which is adjustable in force resistance so as to enable its use by golfers having different strength levels or skill.

SUMMARY OF THE INVENTION

The present invention is a golf swing exercise apparatus which includes an extension means exhibiting force resistance to extension. The extension means includes first and second ends with first and second attachment means respectively associated with the first and second ends to attach the extension means at the first end to a stationary support surface and at a second end to removably receive the shaft of a golf club.

Preferably, the extension means comprises an elastic band which exhibits resistance to elongation. The first and second attachment means preferably comprise loops formed on each end of the band which define apertures for mounting about a support surface or for receiving the shaft of a golf club, respectively.

The means for attaching the first end of the band to a support surface, in one embodiment, includes a bracket mountable in a stationary surface, such as beneath the bottom of a door. The bracket has an upright post fixed at one end which receives the loop formed on the first end of the extension band. The bracket includes a planar base having opposed side edges. A leg is formed contiguous with the base and extends perpendicularly from one side edge of the base. A support extends outward from the other side edge of the base. The post is fixedly connected to the support and extends substantially perpendicular thereto. The bracket is mountable beneath the bottom edge of a door or is attachable tó any stationary surface, such as a wall or floor, by means of suitable fasteners which are mountable through the bracket.

The band may be provided in any length and with any width or thickness. The width and thickness of the band may be varied to enable the band to be provided with different force resistance levels thereby enabling the golf swing exercise apparatus of the present invention to be employed by many different golfers, including men or women, adults or children, or golfers having different skill and strength levels. Further, the varying force levels afforded by different sized bands also enables a golfer to increase his strength by progressively using bands having increasingly higher resistance levels.

The golf swing exercise apparatus of the present invention is easy to use and is mountable on any door, wall or other support surface. It has a small, compact, lightweight shape for ease in portability thereby enabling its use indoors. The apparatus has no interacting parts which are susceptible to breakage. Further, the golf swing exercise apparatus of the present invention may be used by either right or left handed golfers and is employable with an actual golf club, including any wood, iron and putter. As noted above, the elastic band may be provided in varying thicknesses or widths to thereby provide various force resistance levels to enable the band to be advantageously employed by different users.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
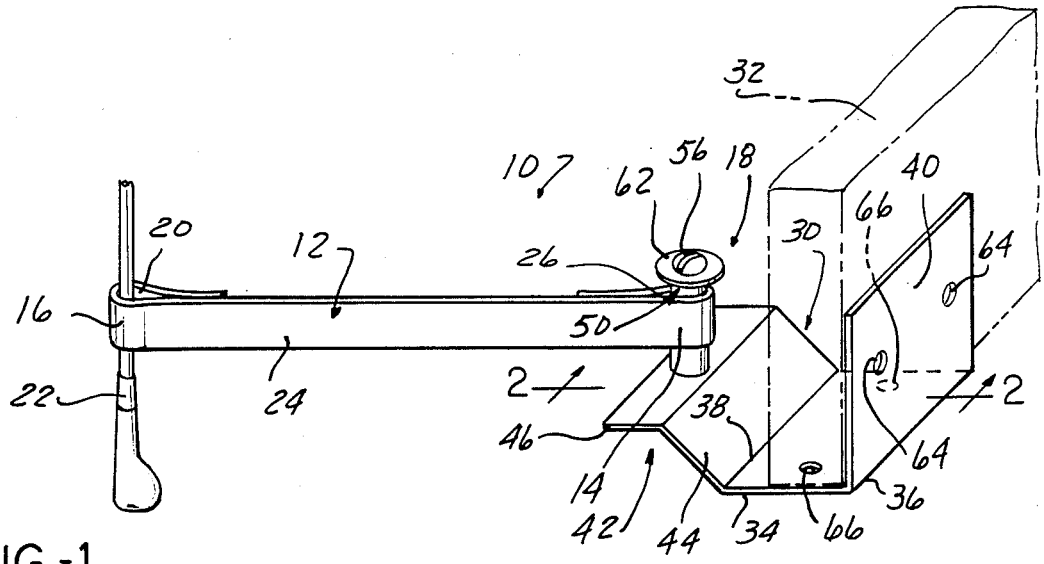
FIG. 1 is a perspective view of a golf swing exercise apparatus constructed in accordance with the teachings of the present invention and shown mounted beneath the bottom edge of a door.

Throughout the following description and drawing, an identical reference number is used to refer to the same component shown in multiple figures of the drawing.

Figure 2:
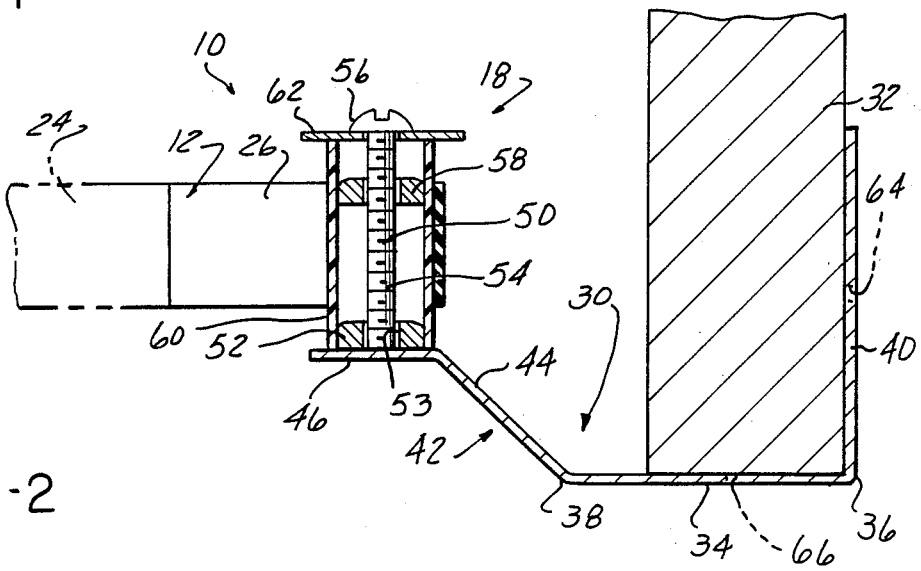
FIG. 2 is a cross sectional view generally taken along line 2—2 in FIG. 1.

Referring now to the drawing, and to FIGS. 1 and 2 in particular, there is illustrated a golf swing exercise apparatus denoted in general by reference number 10. The apparatus 10 includes a resistance extension means 12 which is extendable against an internal resistance. The extension means 12 has first and second ends 14 and 16, respectively. The apparatus 10 also includes a first means 18 for attaching the first end 14 of the extension means 12 to a stationary support surface and a second means 20 for removably attaching the second end 16 of the extension means 12 about the shaft 22 of a golf club.

In a preferred embodiment, the extension means 12 comprises a stretchable, elongatable band 24. Preferably, the band 24 is formed of an elastic material, such as rubber, which exerts a resistance to elongation or stretching. The amount of resistance to elongation or stretching is determined by the thickness and/or the width of the band 24. The thickness and/or width of the band 24 may be varied to provide difference force levels to enable the golf swing exercise apparatus 10 to be employed by many different users, such as children or adults, men or women, as well as users having different skill and strength levels.

The first attaching means 18 comprises a loop 26 which is formed on the first end 14 of the band 24. Preferably, the loop 26 is formed by folding over the first end 14 of the band 24 on itself and securing the end of the main portion of the band 24 by any suitable means. Preferably, the end of the band 24 may be secured to itself to form the loop 26 by adhesive, vulcanization or other suitable means. The loop 26 may thus be secured about any stationary support surface to anchor the band 24 at the first end 14.

The second attaching means 20 also is in the form of a loop which is formed identical to the first loop 26 but at the second end 16 of the band 24. The second loop 20 is adapted to removably receive the shaft 22 of a golf club therethrough as shown in FIG. 1.

In another embodiment of the present invention, the first attaching means 18 comprises the first loop 26 and a bracket means 30 which is removably mountable about any stationary support surface, such as below the bottom edge of a door shown in phantom in FIG. 1 by reference number 32. Preferably, the bracket means 30 is formed of a single piece bent or formed to the shape illustrated in FIGS. 1 and 2. The bracket means 30 may be formed of plastic or any suitable metal.

The bracket means 30 includes a planar base 34 having a first side edge 36 and a second side edge 38. The width of the base 34 is selected so that it is at least as large and preferably slightly larger than the width of conventional doors. A leg 40 is joined to or integrally formed with the base 34 and extends perpendicularly from the first side edge 36. The leg 40 is adapated to engage one vertically extending surface of a door 32 to secure the bracket means 30 to the door 32. A cushion pad, not shown, may be affixed to one side of the leg 40 to protect the door 32 from abrasion when the bracket means 30 is mounted thereon.

The bracket means 30 also includes a support means denoted by reference number 42 which is secured to or formed with the base 34 and extends from the second side edge 38 of the base 34. The support 42 includes an inclined portion 44 extending angularly upward from the base 34 and a generally horizontal, planar portion 46 extending outward from the uppermost edge of the inclined portion 44 away from the inclined portion 44.

A post denoted in general by reference number 50 is fixedly mounted to and extends outward from the planar portion 46 of the support 42. The loop 26 attached to the first end 14 of the band 24 is removably mountable over the post 50 to secure one end 14 of the band 24 to the bracket means 30. Preferably, the post 50 comprises a cylindrical shaft formed by any suitable means.

By way of example only, a weld nut 52 having a centrally threaded aperture is welded to the uppermost surface of the planar portion 46 of the support 42. A threaded bolt 54 having an enlarged head or cap 56 is threadingly engaged into the threaded aperture 53 in the weld nut 52 and extends outward therefrom.

A second nut 58 is threaded about the bolt 54 and is situated approximate the upper end of the bolt 54 and spaced from the head 56 to provide support for a cylindrical sleeve or tube 60. The sleeve 60 is disposed about the bolts 52 and 58 and provides a mounting surface for the loop 26 on the first end 14 of the band 24. An enlarged diameter, planar washer 62 is disposed above the uppermost end of the cylindrical sleeve 60 and below the head 56 of the bolt 54 to retain the sleeve 60 in place.

In mounting the bracket means 30 to a support surface, the leg 40 and the base 34 are disposed about the bottom edge of the door 32 with the leg 40 abutting one vertically extending surface of the door 32 and the base 34 located below the bottom edge of the door 32. Extension of the band 24, as described hereinafter, will pull the leg 40 into contact with the door 32 and prevent further movement of the bracket means 30. Alternately, as shown in FIGS. 1 and 2, pairs of spaced apertures 64 and 66 are formed in the leg 40 of the base 34, respectively. The apertures 64 and 66 receive fasteners, not shown, for fixedly mounting the bracket means 30 to a support surface, such as a wall or floor.

In use, the bracket means 30 of the golf swing exercise apparatus 10 is mounted to a stationary surface, such as below the bottom edge of a door 32. The first loop 26 is disposed over the post 50 on the bracket means 30. The shaft 22 of a golf club is removably inserted through the second loop 20 on the band 24. It should be noted that the bracket means 30 is positioned along the length of the door 32 at any suitable location depending upon whether the golfer is right or left handed.

The golf swing exercise apparatus 10 of the present invention may be employed in a variety of ways to practice various aspects of a golf swing. The golf swing apparatus 10 may be employed to teach timing, coordination of movements, leg action, balance, as well as strengthening of the wrist, arms and shoulder of a user.

Figure 3:
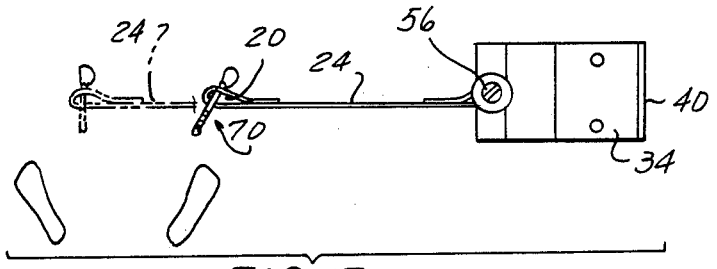
FIGS. 3 and 4 are plan pictorial views showing various uses of the golf swing exercise apparatus of the present invention.

As shown in FIG. 3, the golf swing exercise apparatus 10 is configured for pulling a golf club 70 through the location of an imaginary ball properly located between the feet of a user. As shown in FIG. 3, the user positions his feet such that the location of the imaginary golf ball which the user is addressing would be located in line with the inside edge of the leftmost foot of the user. The golf club 70 is inserted through the second loop 20 on the band 24 and positioned from one to two feet outside of the right foot with the band 24 in its normal, unextended position. The golf club 70 may then be urged against the force resistance provided by the band 24 toward the imaginary ball location inside the left foot of the user in a straight line as shown in phantom in FIG. 3. This simulates the end of the downswing of a golf swing and teaches the user proper timing and balance, as well as strengthening wrist, arm and shoulder muscles. The amount of distance the golf club 70 and the band 24 are moved may vary depending upon the desire of the user and the amount of practice and/or strength he or she wishes.

Figure 4:
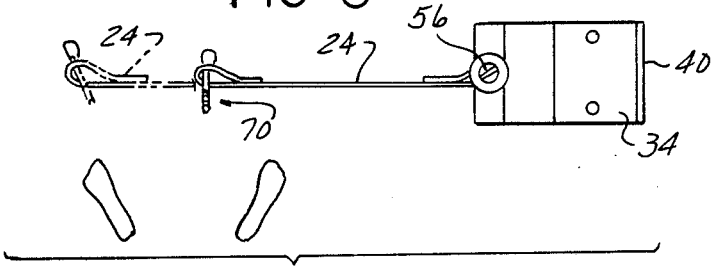

FIG. 4 illustrates another use of the golf swing exercise apparatus 10 in which the club 22 is pulled through the imaginary location of a ball. In this use application, the user positions an imaginary ball inside his left foot with the club 70 extending substantially perpendicular to his or her body and the band 24 in its normal, unextended position. The user then urges the golf club 70 to the left, in the orientation shown in FIG. 4, overcoming the resistance of the band 24 to the imaginary position shown in phantom in FIG. 4. This simulates the beginning of the follow through portion of a golf swing. The gold club 70 may be held at the extended position to strengthen the user's muscles.

In summary there has been disclosed a unique golf swing exercise apparatus which provides significant advantages over previously devised golf swing exercise and training devices. The golf swing exercise apparatus of the present invention is lightweight, compact and easy to use. This provides excellent portability, for the golf swing exercise apparatus thereby enabling its use in any location. The golf swing exercise apparatus of the present invention also utilizes an actual golf club which may be any wood, iron or putter. Further, the golf swing exercise apparatus may be used by a user with any strength or skill level, whether or not the user is right or left handed.

What is claimed is:

1. A golf swing exercise apparatus for practicing a golf club swing comprising:

an elastic bond having first and second ends, the elastic band exerting a resistance to extension from a normal unextended length;

bracket means mountable to a stationary surface;

first means for attaching the first end of the band to the bracket means; and second means in the form of a loop formed on the second end of the band for removably attaching the second end of the band to the shaft of a golf club, said bracket means comprising:

a planar base having opposed side edges;

a leg contiguous with the base and extending substantially perpendicular to one side edge of the base;

the base and leg configured for engagement with a stationary surface;

a support extending outward from the other side edge of the base;

a post fixedly connected to and extending substantially perpendicular from the support parallel to the leg, the first attaching means removably attachable about the post.

2. The golf swing exercise apparatus of claim 1 wherein the first attaching means comprises:

a loop formed on one end of the band.

* * * * *